US009101258B2

(12) United States Patent
Cordill et al.

(10) Patent No.: US 9,101,258 B2
(45) Date of Patent: Aug. 11, 2015

(54) MULTIPLE COMPARTMENT DISHWASHER WITH INTERIOR AND EXTERIOR CLOSURE ELEMENTS

(71) Applicant: Whirlpool Corporation, Benton Harbor, MI (US)

(72) Inventors: Rexford W. Cordill, Granger, IN (US); Michael Hamand, Newton, IA (US); Duane M. Kobos, Laporte, IN (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 158 days.

(21) Appl. No.: 13/863,579

(22) Filed: Apr. 16, 2013

(65) Prior Publication Data

US 2014/0306588 A1 Oct. 16, 2014

(51) Int. Cl.
*A47L 15/42* (2006.01)
*A47L 15/00* (2006.01)

(52) U.S. Cl.
CPC ..... *A47L 15/4257* (2013.01); *A47L 15/0084* (2013.01)

(58) Field of Classification Search
CPC ..... A47B 77/00; D06F 39/00; A47L 15/4257; A47L 15/4261; A47L 15/4263; A47L 15/4265; A47L 15/4259
See application file for complete search history.

(56) References Cited

U.S. PATENT DOCUMENTS

| | | | | |
|---|---|---|---|---|
| 2,624,909 | A | 1/1953 | Kujawa | |
| 3,248,159 | A | 4/1966 | Hall | |
| 3,288,154 | A | 11/1966 | Jacobs | |
| 3,367,730 | A | 2/1968 | Andrews, et al. | |
| 3,430,638 | A | 3/1969 | Brollo | |
| 5,398,528 | A | 3/1995 | Johnston et al. | |
| 5,496,104 | A * | 3/1996 | Arnold et al. | 312/204 |
| 6,260,565 | B1 | 7/2001 | Welch et al. | |
| 6,460,555 | B1 | 10/2002 | Tuller et al. | |
| 8,043,437 | B1 * | 10/2011 | Delgado et al. | 134/18 |
| 2008/0210277 | A1 | 9/2008 | Kramer | |
| 2011/0120195 | A1 | 5/2011 | Jeoung et al. | |

FOREIGN PATENT DOCUMENTS

| | | | | |
|---|---|---|---|---|
| DE | 1980332 | U | 3/1968 | |
| DE | 10161658 | A1 | 6/2003 | |
| EP | 1329175 | B1 | 5/2006 | |
| EP | 1776914 | A1 | 4/2007 | |
| EP | 2060852 | A1 * | 5/2009 | A47L 15/42 |
| EP | 2141277 | A1 | 1/2010 | |
| GB | 2079589 | A | 1/1982 | |

(Continued)

OTHER PUBLICATIONS

European Search Report for Counterpart EP12194115.7, Mar. 28, 2013.

*Primary Examiner* — Michael Barr
*Assistant Examiner* — Tinsae Ayalew

(57) ABSTRACT

A dishwasher may comprise a tub at least partially defining multiple treating chambers and further defining an access opening for the treating chambers. Interior closure elements may selectively close the access openings, and examples of the interior closure elements include a pivoting door and a drawer front. An exterior closure element mounted to the dishwasher for movement relative to the tub may overlie the interior closure elements when closed.

21 Claims, 9 Drawing Sheets

(56) References Cited

FOREIGN PATENT DOCUMENTS

| | | | |
|---|---|---|---|
| GB | 2114432 | A | 8/1983 |
| JP | 2001275915 | A | 10/2001 |
| JP | 2001327451 | A | 11/2001 |
| JP | 2002300998 | A | 10/2002 |
| JP | 3494117 | B2 | 2/2004 |
| JP | 3494124 | B2 | 2/2004 |
| JP | 3494164 | B2 | 2/2004 |
| JP | 2005110901 | A | 4/2005 |
| JP | 2005143516 | A | 6/2005 |
| JP | 2007044550 | A | 2/2007 |
| JP | 2008092985 | A | 4/2008 |
| JP | 4484857 | B2 | 6/2010 |
| JP | 2011015767 | A | 1/2011 |
| JP | 4893785 | B2 | 3/2012 |
| WO | 2006072904 | A1 | 7/2006 |
| WO | 2009123530 | A1 | 8/2009 |

* cited by examiner

MULTIPLE COMPARTMENT DISHWASHER WITH INTERIOR AND EXTERIOR CLOSURE ELEMENTS

BACKGROUND

Contemporary automatic household dishwashers may have multiple compartments for receiving soiled dishes to be treated. In multiple compartment dishwashers, the compartments can be in the form of multiple, separate drawers or pull-out compartments, and each compartment can include a slidable tub defining a treating chamber. One or more holders in the multiple compartment dishwashers may be disposed inside and moveable with its respective treating chamber to support the dishes in the treating chamber. The treating chambers of a multiple compartment dishwasher can alternatively be formed by one or more partitions in the stationary tub. The dish holders may be slidably mounted to the tub and movable relative to the treating chambers to support the dishes.

SUMMARY

A dishwasher automatically executing at least one cycle of operation for treating dishes according to one embodiment comprises a tub at least partially defining a first dish treating chamber and a second dish treating chamber and further defining an access opening through which access is provided to the first and second treating chambers. A first interior closure element movable relative to the tub selectively closes a portion of the access opening corresponding to the first treating chamber, thus preventing access to the first treating chamber. A second interior closure element movable relative to the tub to selectively closes a portion of the access opening corresponding to the second treating chamber, thus preventing access to the second treating chamber. An exterior closure element mounted to the dishwasher for movement relative to the tub provides selective access to the first and second interior closure elements, wherein the exterior closure element overlies the first and second interior closure elements when the exterior closure element is closed.

DESCRIPTION OF EMBODIMENTS OF THE INVENTION

Figure 1:
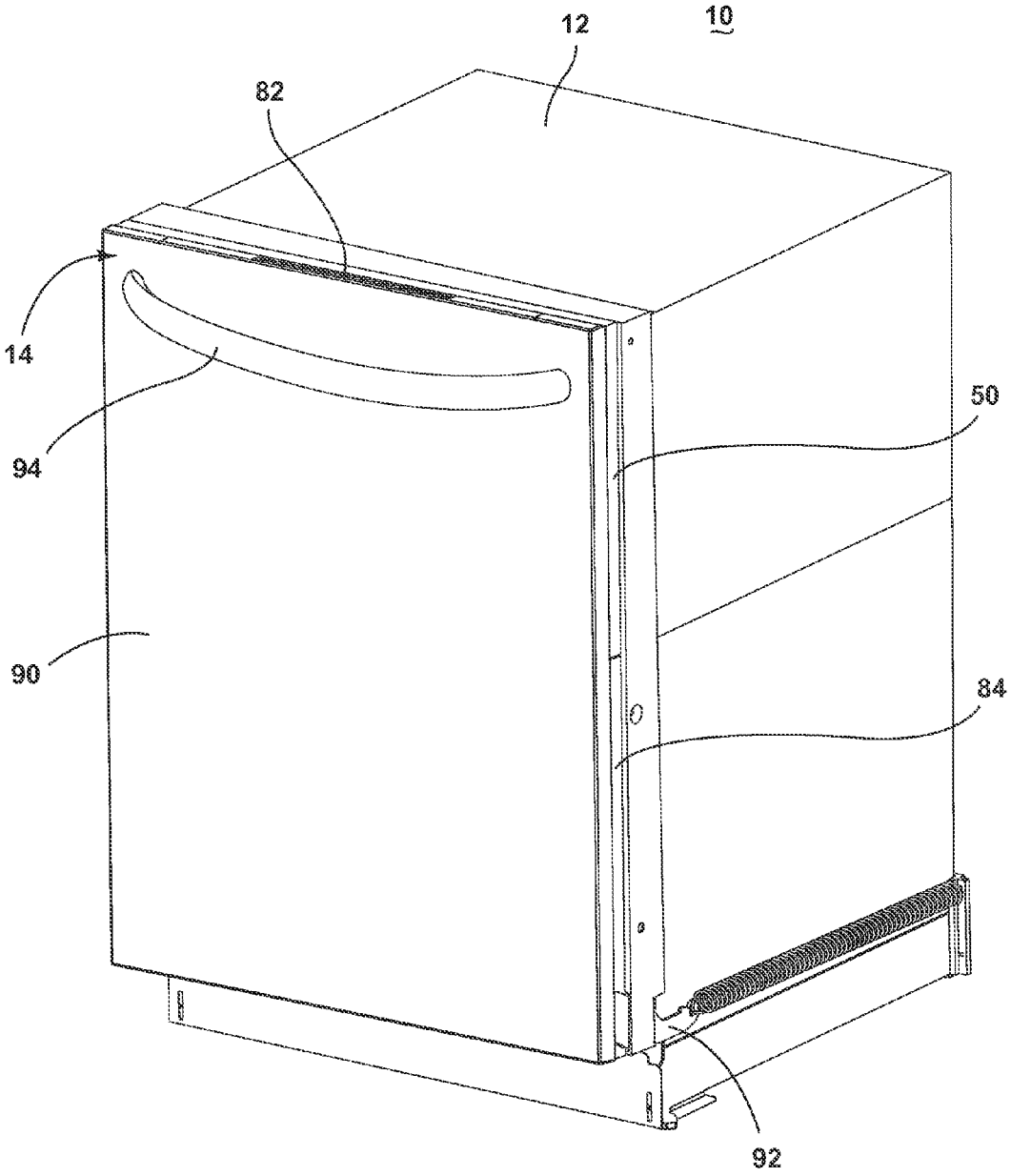
FIG. 1 is a perspective view of a multi-compartment dishwasher having a closure element system according to one embodiment.

FIG. 1 is a perspective view of a multi-compartment dishwasher 10 according to an embodiment of the invention. Although the actual dishwasher 10 into which the embodiments of the invention may be incorporated may vary, the invention is shown in connection with the dishwasher 10 for illustrative purposes. The dishwasher 10 includes a chassis 12 and a closure element system 14 mounted to the chassis 12. The chassis 12 may be a cabinet or a frame, with or without exterior panels. Built-in dishwashers typically have only a frame without panels, whereas stand-alone dishwashers have a frame with decorative panels covering the frame.

Figure 2:
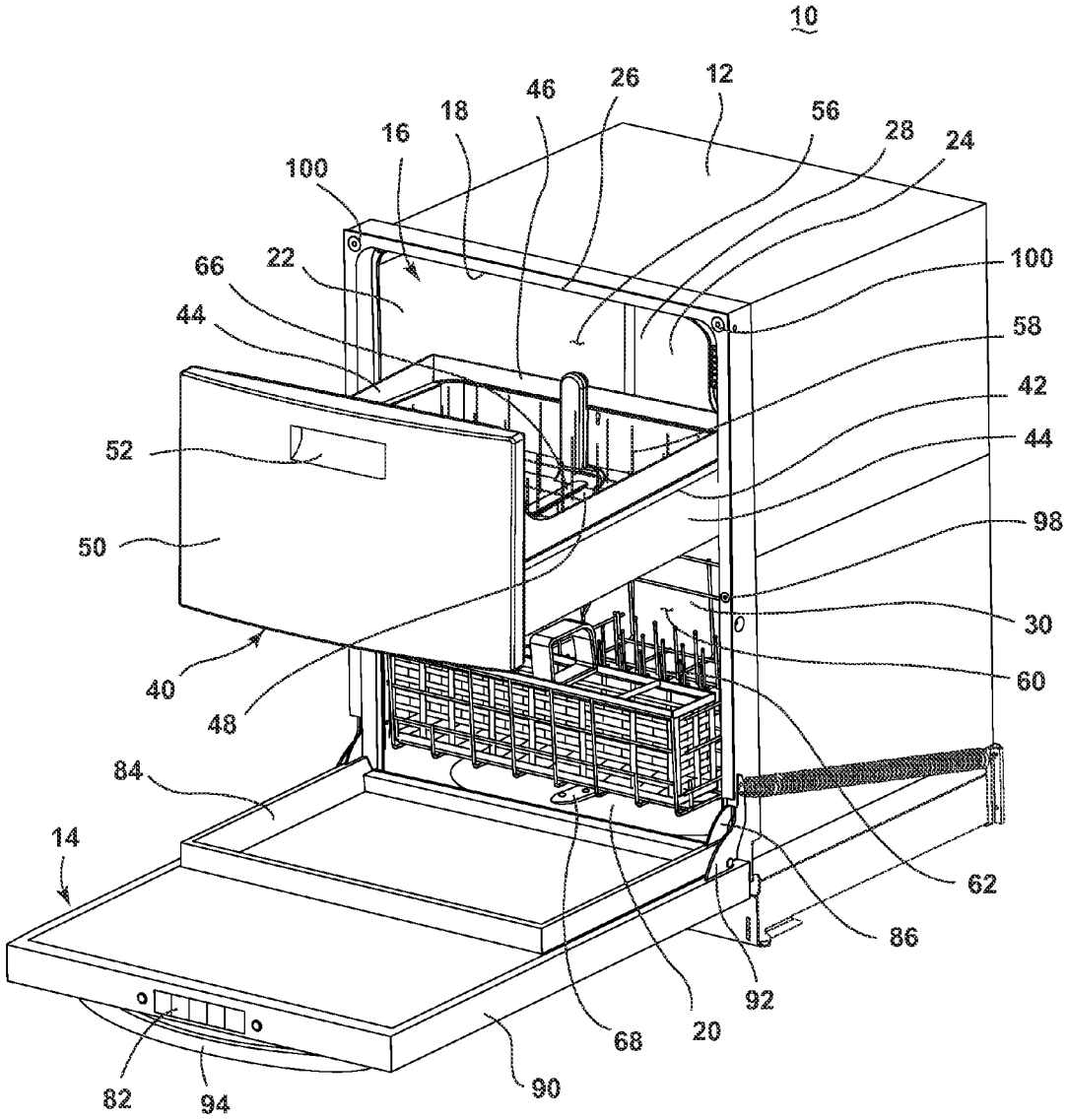
FIG. 2 is a perspective view of the dishwasher of FIG. 1 with an exterior closure element and interior closure elements of the closure element system in opened positions.

Referring now to FIG. 2, which is a perspective view of the dishwasher 10 with the closure element system 14 in an opened position, the dishwasher 10 may comprise a tub 16 having opposing top and bottom walls 18, 20, opposing side walls 22, and a rear wall 24. The front edges of the top and bottom walls 18, 20 and the opposing side walls 22 collectively form an access opening 26 for the tub 16. The interior of the tub 16 may include any number of multiple compartments, and the illustrated embodiment features two compartments, an upper compartment 28 and a lower compartment 30. The upper and lower compartments 28, 30 may have any relative sizing, with the upper compartment 28 being smaller than, larger than, or the same size as the lower compartment 30.

Figure 3:
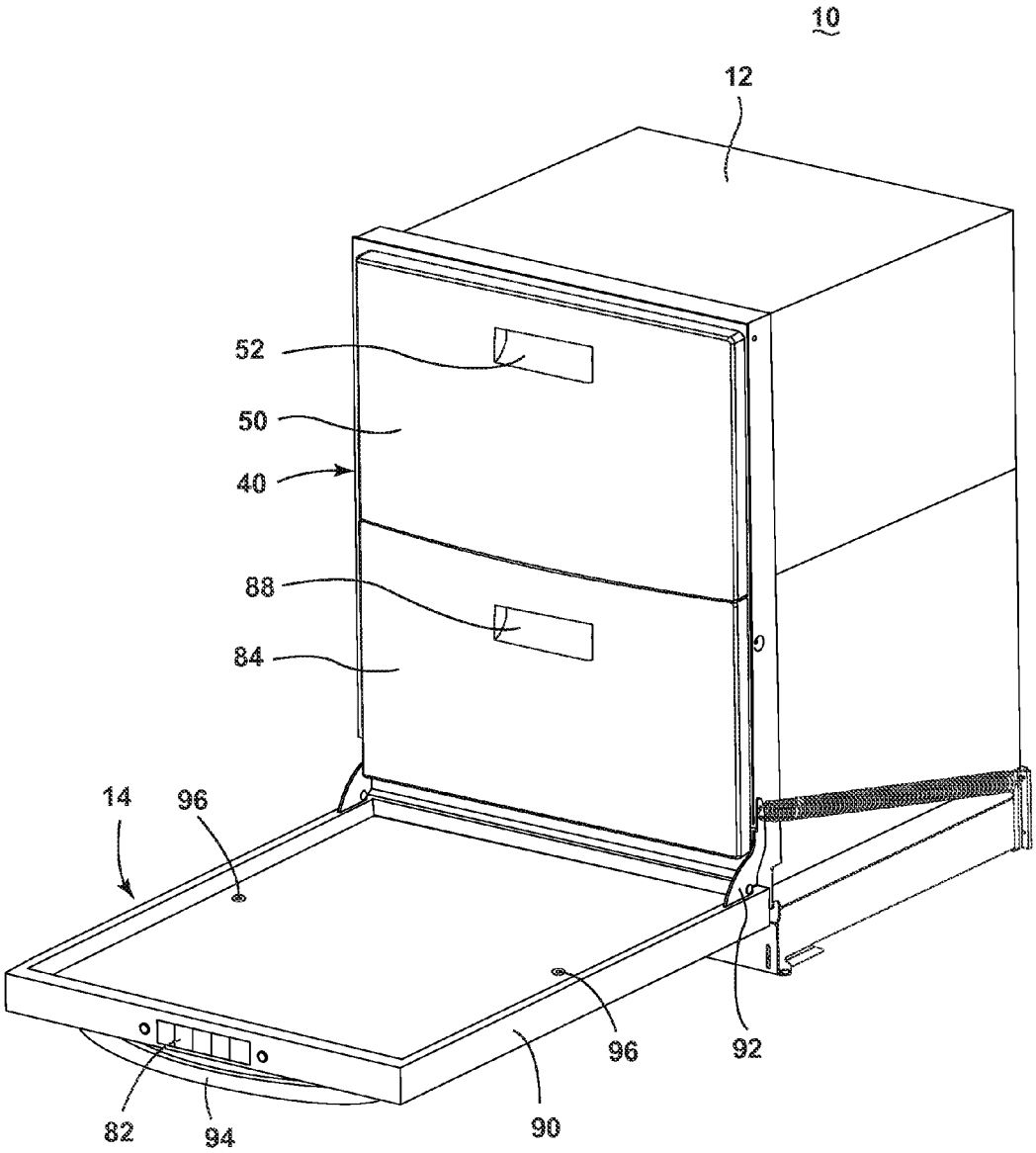
FIG. 3 is a perspective view of the dishwasher of FIG. 1 with the interior closure elements in closed positions and the exterior closure element in the opened position.

The upper compartment 28 may be at least partially formed by a drawer 40 slidably mounted to the side walls 22 by slide rails 42. The slide rails 42 may be well-known, conventional drawer slides; alternatively, the drawer 40 may be mounted to the side walls 22 by other suitable extendible support guides or attachment devices. The drawer 40 includes opposing side walls 44 joined by a rear wall 46, a bottom wall 48, and a front panel 50 in which is formed a drawer handle 52. The front panel 50 may form the front wall of the drawer 40; alternatively, the drawer 40 may have a front wall separate from the front panel 50, which could be mounted to the drawer front wall, or integral with the front panel 50. The drawer handle 52 may be any suitable type of handle 52, including a pocket handle, as shown in the figures, and facilitates movement of the drawer 40 between an extended position when slid forward out of the tub 16, as shown in FIG. 2, and a retracted position when slid rearward into the tub 16, as shown in FIG. 3. Referring back to FIG. 2, the drawer 40 and the portion of the tub 16 in the upper compartment 28 may collectively form an upper tub defining an upper treatment chamber 56. The drawer 40 may be provided with a dish holder 58 for supporting various objects, such as dishes and the like, to be exposed to a treating operation in the upper treatment chamber 56. As used in this description, the term "dish(es)" is intended to be generic to any item, single or plural, that may be treated in the dishwasher 10, including, without limitation, dishes, plates, pots, bowls, pans, glassware, and silverware.

The lower compartment 30 may include a lower tub collectively formed by the underside of the drawer 40 and the portion of the tub 16 below the drawer 40 to define a lower treatment chamber 60. Alternatively, the dishwasher 10 may include a partition, such as a wall, below the drawer 40 to physically separate the tub 16 into the upper and lower compartments 28, 30 rather than having the drawer 40 form the partition. A dish holder 62 for supporting various objects, such as dishes and the like, to be exposed to a treating operation may be located in the lower treatment chamber 60. The holder 62 may have wheels (not shown) on its lower side such that the holder 62 may roll on the closure element system 14 between an extended position when slid forward out of the tub 16 and a retracted position when slid rearward into the tub 16. Alternatively, the holder 62 may be slidably mounted to the side walls 22 by slide rails. The slide rails may be well-known, conventional drawer slides or other suitable extendible support guides or attachment devices.

Figure 4:
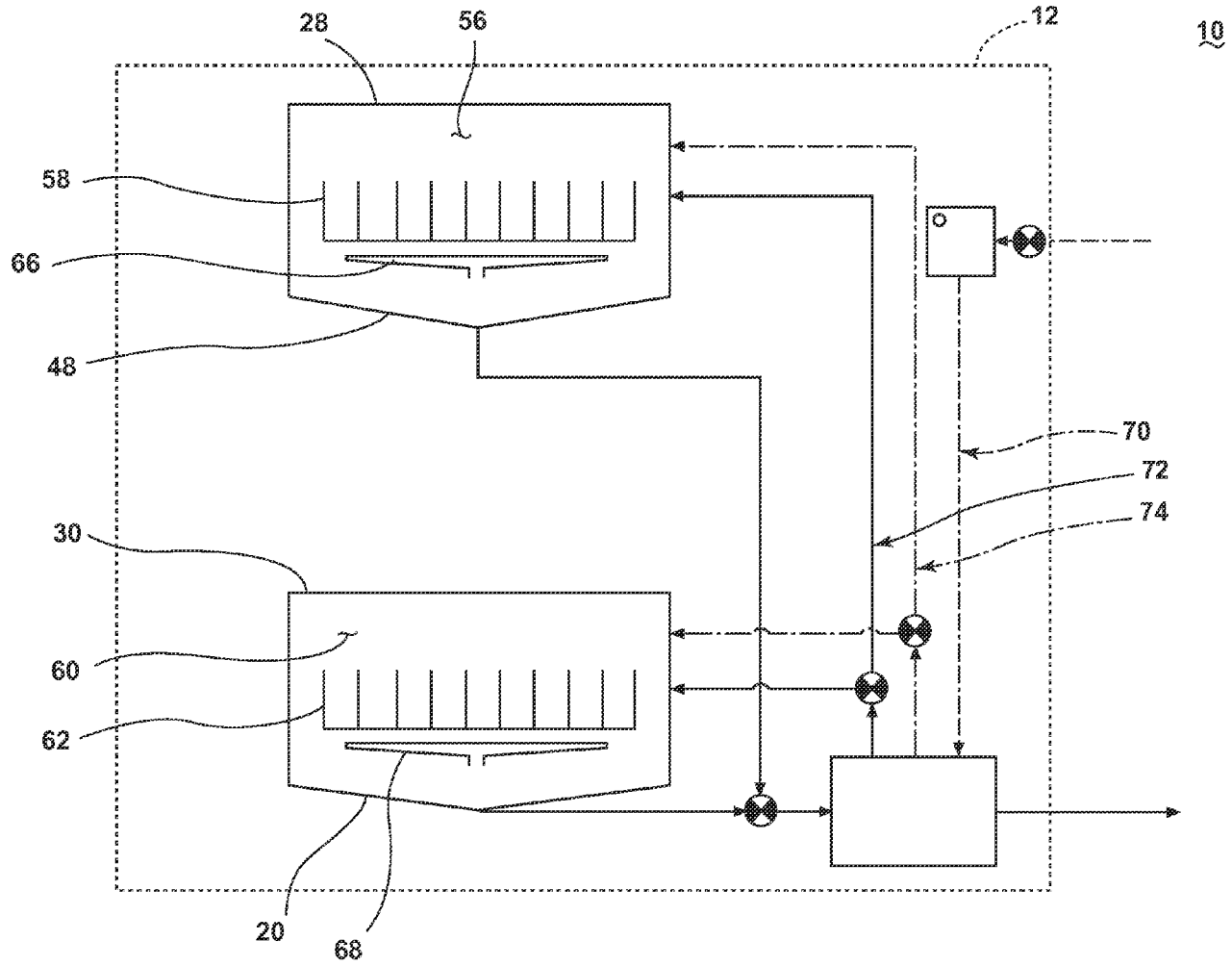
FIG. 4 is a schematic view of exemplary liquid and air systems for the dishwasher of FIG. 1.

Referring now to FIG. 4, a spray system may be provided for spraying liquid or a mixture of gas and liquid, including foams, hereinafter collectively referred to as liquid, within the upper and lower treatment chambers 56, 60. The spray system may include a sprayer of some type for spraying liquid in the treatment chamber. As illustrated, sprayers 66, 68 may be located in the upper treatment chamber 56 and lower treatment chamber 60, respectively, to function as fluid inlets for the upper and lower treatment chambers 56, 60. The sprayers 66, 68 may comprise a traditional spray arm located below the holders 58, 62, for example, configured to rotate and generate a spray of liquid in a generally upward direction, over at least a portion of the respective upper and lower treatment chambers 56, 60, typically directed to treat dishes located in the holders 58, 62. Alternatively or additionally, the sprayers 66, 68 may include other types of spray assemblies, including stationary sprayers, zone sprayers, individual spray nozzles, and the like, located at any suitable location. The type, number, and location of the sprayers 66, 68 are not germane to the present invention, and the sprayers 66, 68 need not be the same type of sprayers. The sprayers 66, 68 may function independently of each other or in concert with one another. Optionally, the bottom wall 48 of the drawer 40 and the bottom wall 20 of the tub 16 may be sloped to function as a sump or fluid outlet to drain treatment fluid from the respective upper and lower treatment chambers 56, 60.

With continued reference to FIG. 4, the spray system may operatively communicate with a liquid supply system 70 (dash-dash-dot line) that supplies liquid from an external source and a liquid circulation system 72 (solid line) that supplies the liquid from the external source or recirculated liquid to the sprayers 66, 68 and receives liquid from the fluid outlet or drain in each of the upper and lower treatment chambers 56, 60 to either recirculate the liquid or drain the liquid from the dishwasher 10. An exemplary liquid supply system 70 and an exemplary liquid circulation system 72 are shown and described in U.S. patent application Ser. No. 13/681,547, filed Nov. 20, 2012, which is incorporated herein by reference in its entirety. The dishwasher 10 may also include an air supply system 74 (dash-dot-dash line), an example of which is also provided in the aforementioned incorporated patent application. The liquid supply and circulation systems 70, 72 and the air supply system 74 are not germane to the invention; any suitable systems capable of supplying, delivering, recirculating, and draining liquid and any suitable system for supplying and delivering air may be employed with the dishwasher 10.

Figure 5:
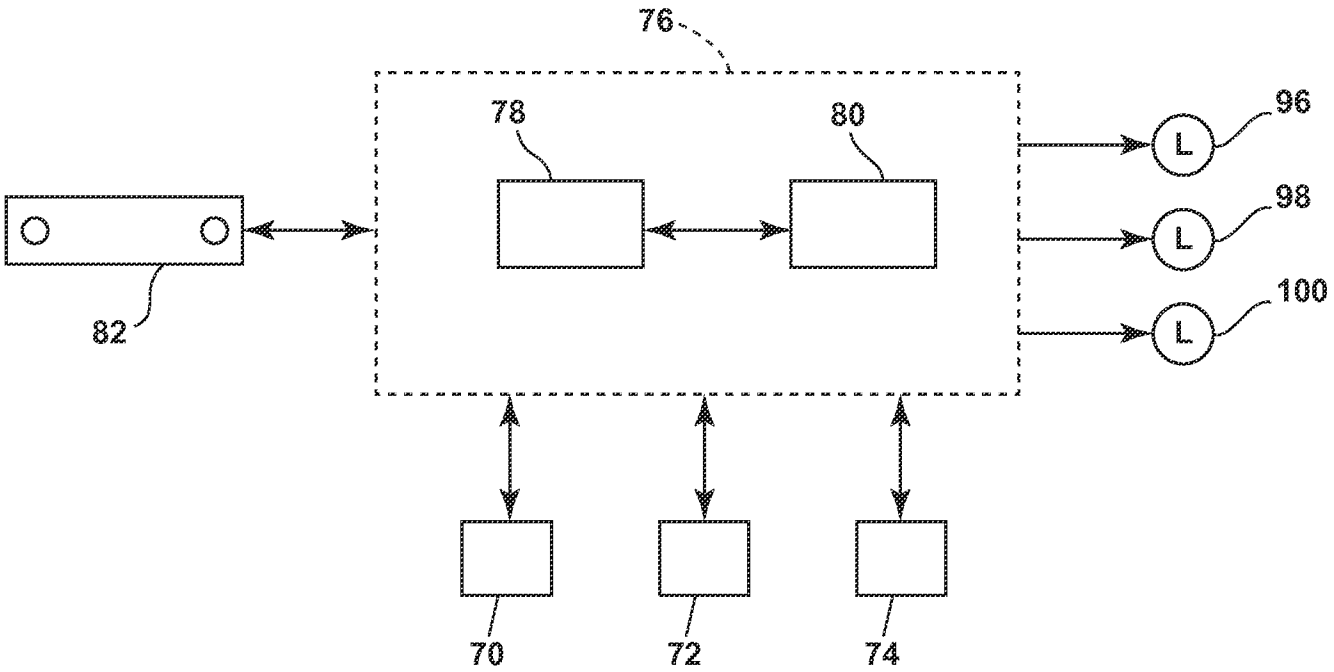
FIG. 5 is a schematic view of a controller for the dishwasher of FIG. 1.

Referring now to FIG. 5, the dishwasher 10 may also have an electronic control, shown in the illustrated embodiment as a controller 76. The controller 76 may be a single controller for both the upper and lower treatment chambers 56, 60 and may be operably coupled to various components of the dishwasher 10, such as components of the liquid supply and circulation systems 70, 72 and of the air supply system 74, to implement a treating cycle of operation in one or both of the upper and lower treatment chambers 56, 60. The controller 76 may communicate with the components of the dishwasher 10 over a wireless communication link using a wireless communication protocol. The wireless communication link and protocol may be any type of wireless communication, including radio frequency, microwave, and infrared (IR) communications, and communications involving bit by bit, RS232, WIDE (a network protocol developed by Whirlpool, the assignee of the present patent application), 12C, etc. The controller 76 may also communicate with the user over Wi-Fi or wireless telecommunications to a portable computing device, such as a tablet computer or phone, for controlling the dishwasher 10 remotely. Alternatively, the controller 76 may communicate with the components of the dishwasher 10 over wired connections, if desired.

The controller 76 may be provided with a memory 78 and a central processing unit (CPU) 80. The memory 78 may be used for storing control software that may be executed by the CPU 80 in completing a cycle of operation using one or both of the upper and lower treatment chambers 56, 60 of the dishwasher 10 and any additional software. For example, the memory 78 may store one or more pre-programmed cycles of operation that may be selected by a user and completed by one or more of the upper and lower treatment chambers 56, 60. A cycle of operation for the upper and lower treatment chambers 56, 60 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of fluid and/or rinse aid used during each of the multiple rinse steps may be varied. The drying step may have a non-heated drying step (so called "air only"), a heated drying step, or a combination thereof. These multiple steps may be performed within the upper and lower treatment chambers 56, 60 in any desired combination. Further, the controller 76 may execute the same or different treatment cycles started at the same or different times in the upper and lower treatment chambers 56, 60.

A user may communicate with the controller 76 through a user interface 82, which may be disposed at any suitable location on the dishwasher 10 and is shown by example as being located on the closure element system 14. The user interface 82 may include various indicators and/or selectors for communicating with the user of the dishwasher 10. The particular type and location of the user interface 82 is not germane to the invention.

Referring back to FIG. 2, the closure element system 14 for the multi-compartment dishwasher 10 may include an interior closure element for each of the upper and lower treatment chambers 56, 60. The interior closure elements may selectively close the portions of the access opening 26 corresponding to the upper and lower treatment chambers 56, 60. When the upper compartment 28 is in the form of the drawer 40, as illustrated by example, the open top of the drawer 40 may be considered an access opening for the upper treatment chamber 56; however, the access opening 26 defined by the tub 16 also provides access to the upper treatment chamber 56, and the interior closure element selectively closes this latter access opening 26. It follows that the upper interior closure element for the upper compartment 28 in the form of the drawer 40 may be the front panel 50 of the drawer 40. When the drawer 40 is open or in the extended position, as in FIG. 2, the front panel 50 is spaced from the access opening 26, thus allowing user access through the access opening 26 into the portion of the upper treatment chamber 56 in the tub 16 and movement of the dish holder 58 with the drawer 40 through the access opening 26. The front panel 50 blocks such access when the drawer 40 is in the closed or retracted position in FIG. 3 and covers the access opening 26.

With continued reference to FIG. 2, the lower interior closure element in the illustrated embodiment is in the form of a pivoting door 84. The door 84 is sized to cover the portion of the access opening 26 corresponding the lower treatment chamber 60 and is mounted along its bottom edge for pivoting motion about a horizontal axis, such as by a hinge mount 86. Further, the door 84 may optionally include a handle 88 (FIG. 3) to facilitate movement of the door 84 by the user. The door 84 may be moved between an opened position, as shown in FIG. 2, spaced from the access opening 26 such that a user can access the lower treatment chamber 60 through the access opening 26 and the dish holder 62 may be moved relative to the lower treatment chamber 60 through the access opening 26, and a closed position, as shown in FIG. 3, where the door 84 covers the access opening 26 and blocks access to the lower treatment chamber 60. Movement of the door 84 may be independent of the movement of the front panel 50 such that the upper and lower treatment chambers 56, 60 may be accessed independently. The door 84, when closed, may also form the front wall of the lower treatment chamber 60.

The closure element system 14 may further include an exterior closure element, which in the illustrated embodiment, is in the form of an exterior door 90. The exemplary exterior door 90 may be mounted to the tub 16 for pivoting movement about a horizontal axis, such as by a hinge mount 92, relative to the tub 16. The exterior door 90 may be sized to overlie both of the interior closure elements, i.e., the front panel 50 and the door 84 such that when the exterior door 90 is in a closed position, as shown in FIG. 1, the exterior door 90 blocks access to the interior closure elements 50, 84 from the front of the dishwasher 10. When the door 90 is in an opened position spaced from the tub 16, as shown in FIGS. 2 and 3, a user may access the interior closure elements 50, 84. The exterior door 90 may support a handle 94 of any suitable type, including a bar handle as shown in the figures, to facilitate movement of the exterior door 90 between the closed and opened positions.

The exterior door 90 and the interior door 84 may be operatively coupled in a manner that enables independent and/or cooperative movement. For example, when a cycle of operation is running in the lower treatment chamber 60, the interior door 84 may be uncoupled from the exterior door 90 so that the exterior door 90 may be moved between the opened and closed positions while the interior door 84 remains closed. However, the interior door 84 may be coupled with the exterior door 90 in a manner that causes the interior door 84 to open and close simultaneously with the exterior door 90 as long as a cycle of operation is not running in the lower treatment chamber 60. The closure element system 14 may be operatively coupled to the controller 76 for automatic coupling and uncoupling of the interior door 84 and the exterior door 90 in response to the operational state of the lower treatment chamber 60.

Either or both of the interior door 84 and the exterior door 90 may include one or more latches to effect the selective coupling of the doors 84, 90. The latch may be any suitable type of latch, including, but not limited to, mechanical latches, electrical latches, and magnetic latches. The illustrated embodiment includes, as an example, a set of electromagnetic latches 96 located on the interior side of the exterior door 90. The latches 96 may be in operative communication with the controller 76 (FIG. 5) whereby the controller 76 selectively controls power to the latches 96 to activate and deactivate the latches 96. The interior door 84 may be at least partially constructed of a magnetic material, such as a magnetic metal, so that the interior door 84 magnetically couples with the latches 96 and, thereby, the exterior door 90 when the controller 76 activates the latches 96.

As another example, the latches 96 may comprise a striker located on the exterior door 90 that engages a striker bar on the interior door 84, wherein the striker automatically couples with the striker bar when the interior door 84 and the exterior door 90 are adjacent one another, such as when the doors 84, 90 are both closed or both open. The controller 76 may operatively communicate with a latch actuator that selectively releases the striker from the striker bar to uncouple the doors 84, 90 for independent movement of the doors 84, 90. Alternatively, a similar type of mechanical latch may default to the uncoupled condition and switch to the coupled condition when appropriate to couple the doors 84, 90.

As seen in FIG. 2, the dishwasher 10 may include a lock 98 to secure the interior door 84 in the closed position and prevent inadvertent movement of the interior door 84 while a cycle of operation is running in the lower treatment chamber 60. For example, the lock 98 may be in the form of an electromagnet located in the tub 16, and at least part of the interior door 84 may be composed of a magnetic material. In this manner, power supplied to the electromagnet lock 98, as controlled by the controller 76 (FIG. 5), may render the lock 98 magnetic, thereby establishing a magnetic coupling between the electromagnet and the interior door 84. Other suitable types of locks, including mechanical latches, may be used for selectively securing the interior door 84 in the closed position. Additionally, a similar lock 100 may be employed with the interior closure element for the upper treatment chamber 56; in the illustrated embodiment, such a lock would selectively secure the front panel 50 to the tub 16.

Figure 6:
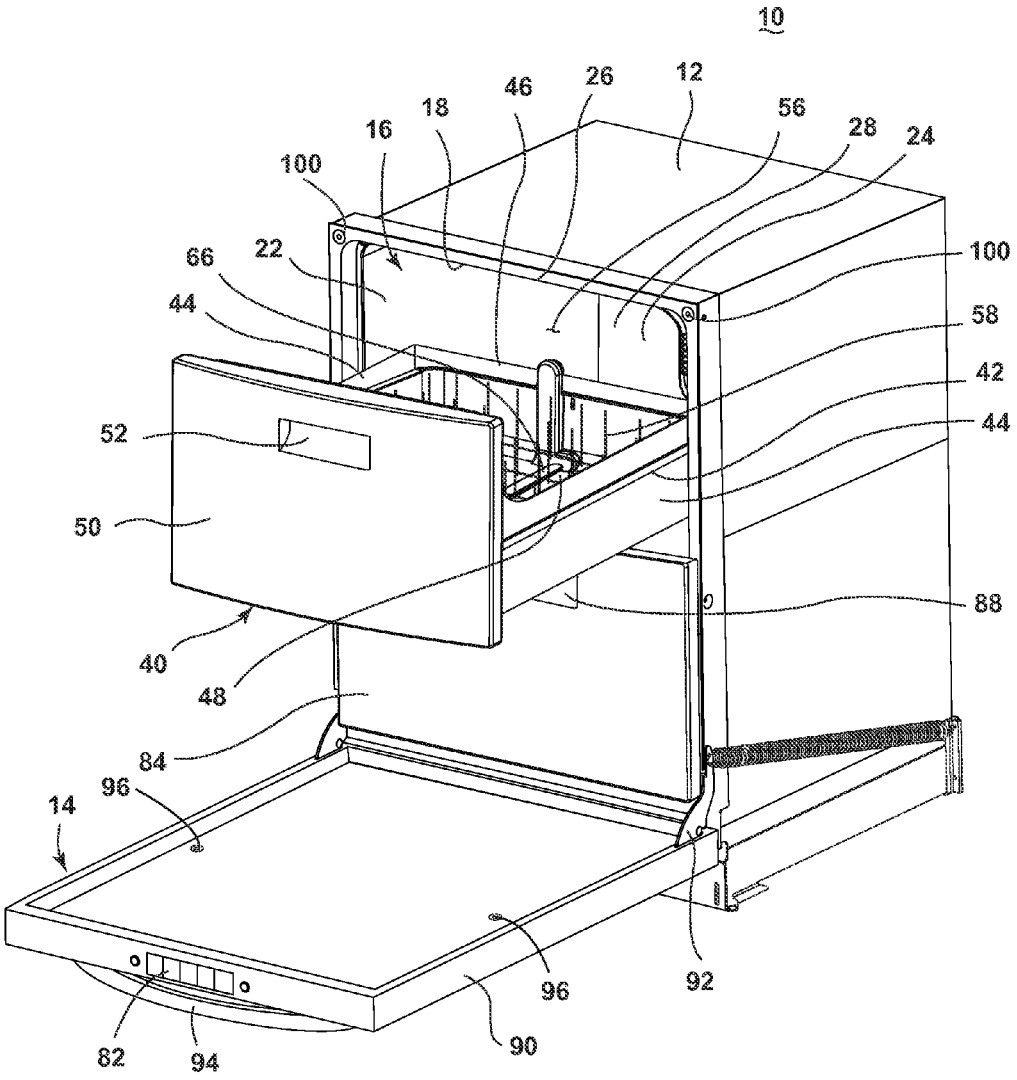
FIG. 6 is a perspective view of the dishwasher of FIG. 1 with the upper interior closure element in the opened position, the lower interior closure element in the closed position, and the exterior closure element in the opened position.
Figure 7:
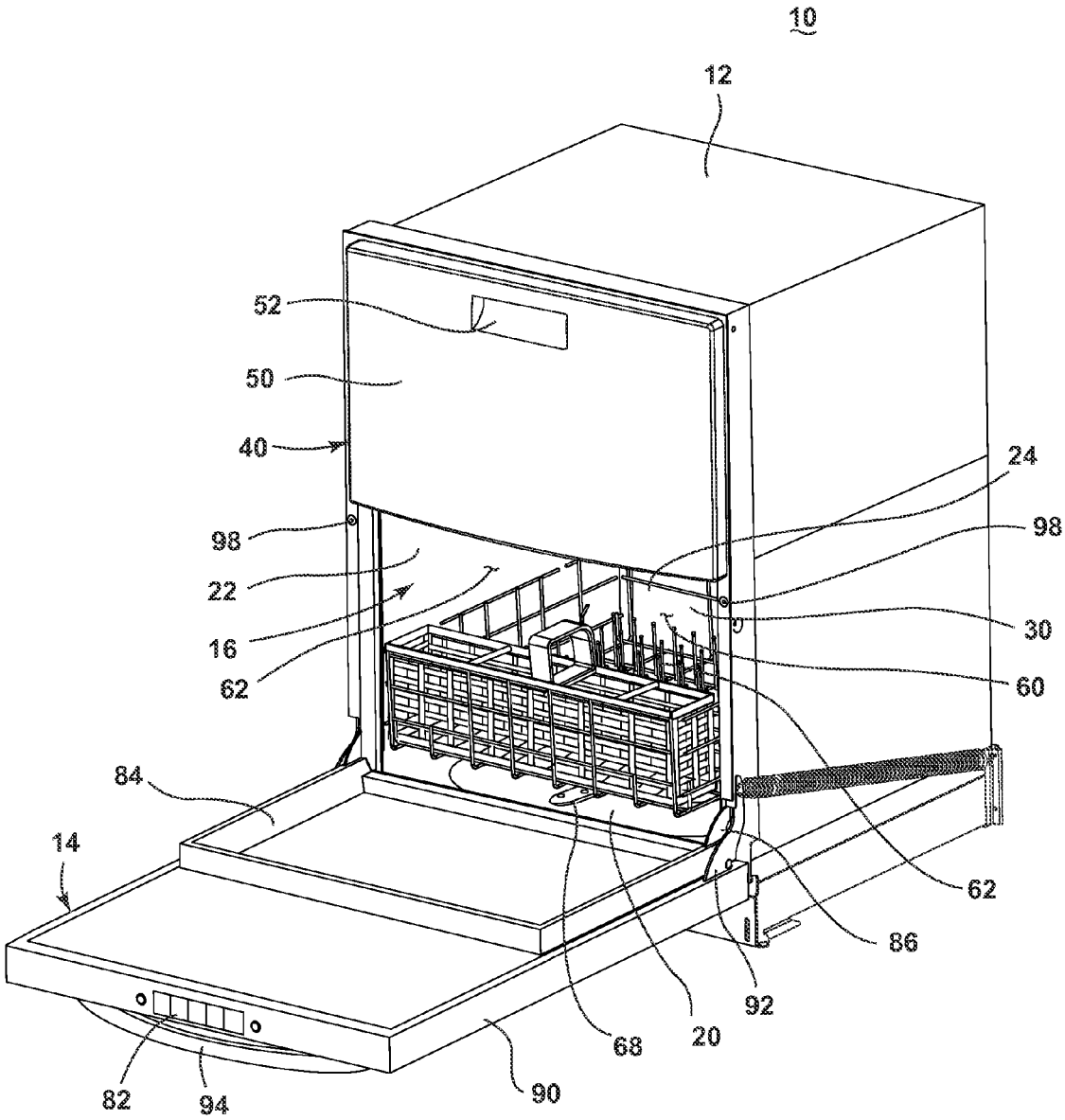
FIG. 7 is a perspective view of the dishwasher of FIG. 1 with the upper interior closure element in the closed position, the lower interior closure element in the opened position, and the exterior closure element in the opened position.

In operation of the dishwasher 10, the closure element system 14 allows the user to access one or both of the treatment chambers 56, 60 depending on the operational state in the treatment chambers 56, 60. For each of the scenarios below, the closure element system 14 is assumed to initially be in a condition where the front panel 50 and the interior door 84 are closed, as is the exterior door 90, as shown in FIG. 1. If a cycle of operation is not running in either treatment chamber 56, 60, a user may open the exterior door 90 to access the interior closure elements. The interior door 84 may optionally open simultaneously with the exterior door 90, and the user may manually open the front panel 50 by sliding the drawer 40 to the extended position. The user can, therefore, independently access both of the upper and lower treatment chambers 56, 60, as seen in FIG. 2. If a cycle of operation is running in only the lower treatment chamber 60, a user may open the exterior door 90 to access the interior closure elements, but the interior door 84 may be locked in the closed position by the lock 98 such that the interior door 84 remains closed while the exterior door 90 opens. The user may then manually open the front panel 50 by sliding the drawer 40 to the extended position to access the upper treatment chamber 56, as seen in FIG. 6. In the situation where a cycle of operation is running in only the upper treatment chamber 56, a user may open the exterior door 90 to access the interior closure elements, but the front panel 50 may be locked in the closed position. The interior door 84 may be coupled to the exterior door 90 for cooperative opening, or, if not, the user may manually open the interior door 84 to access the lower treatment chamber 60, as shown in FIG. 7. If desired, a user may open the exterior door 90 when a cycle (the same cycle) or cycles (different cycles) of operation are running in both of the treatment chambers 56, 60, but neither of the interior closure elements may be opened, as seen in FIG. 3, unless the cycle of operation for a desired treatment chamber 56, 60 is interrupted.

When the user is ready to close the closure element system 14, if the drawer 40 is opened, the user manually closes the drawer 40 such that the front panel 50 covers the access opening 26. If the interior door 84 is opened, the user may manually close the interior door 84, or the user may leave the interior door 84 opened for cooperative closure with the exterior door 90. The user then closes the exterior door 90, which may cooperatively close the interior door 84, to cover the interior closure elements.

Figure 8:
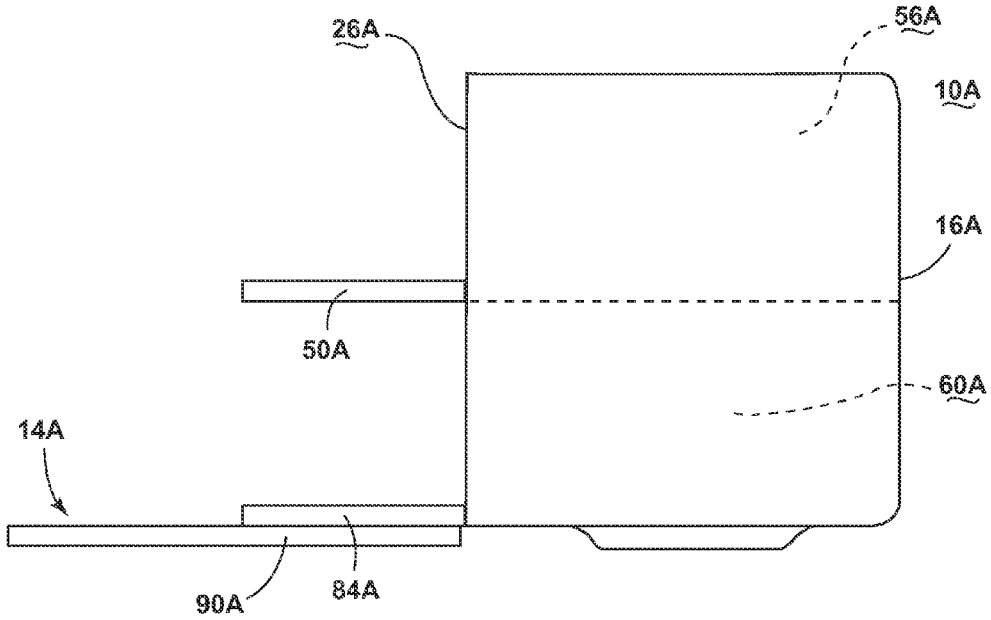
FIG. 8 is a schematic side view of a multi-compartment dishwasher having a closure element system according to another embodiment wherein interior closure elements are in the form of pivoting doors.
Figure 9:
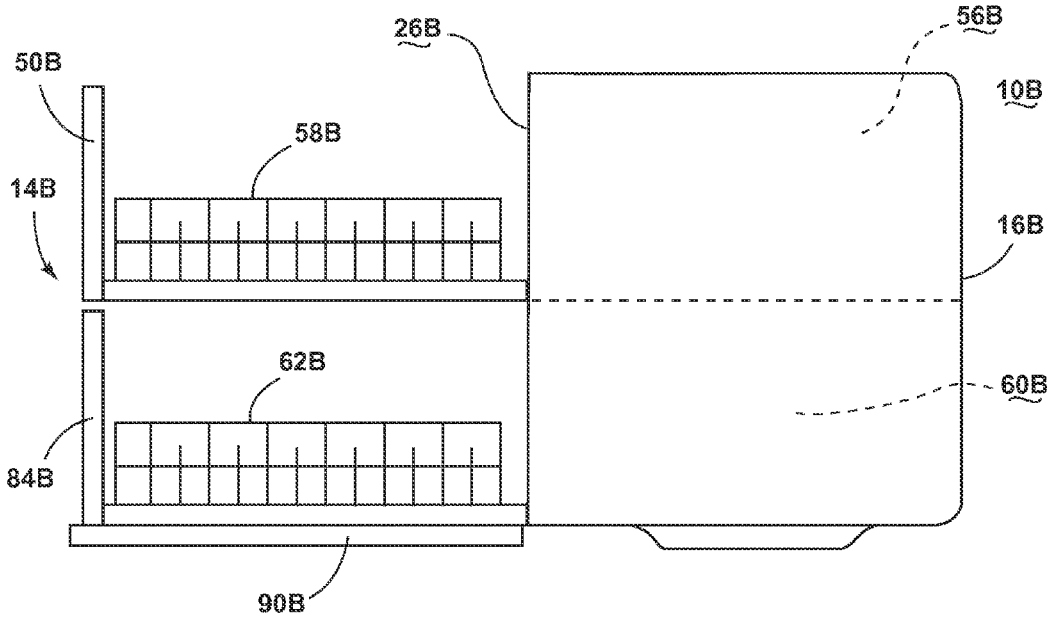
FIG. 9 is a schematic side view of a multi-compartment dishwasher having a closure element system according to another embodiment wherein interior closure elements are in the form of sliding drawer fronts.
Figure 10:
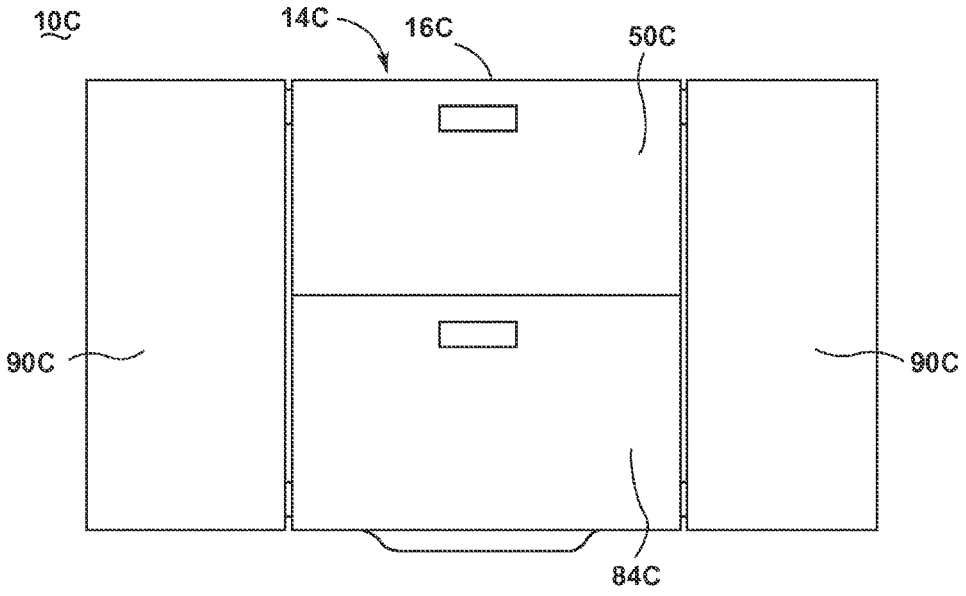
FIG. 10 is a schematic front view of a multi-compartment dishwasher having a closure element system according to another embodiment wherein the exterior closure element is in the form of French doors.
Figure 11:
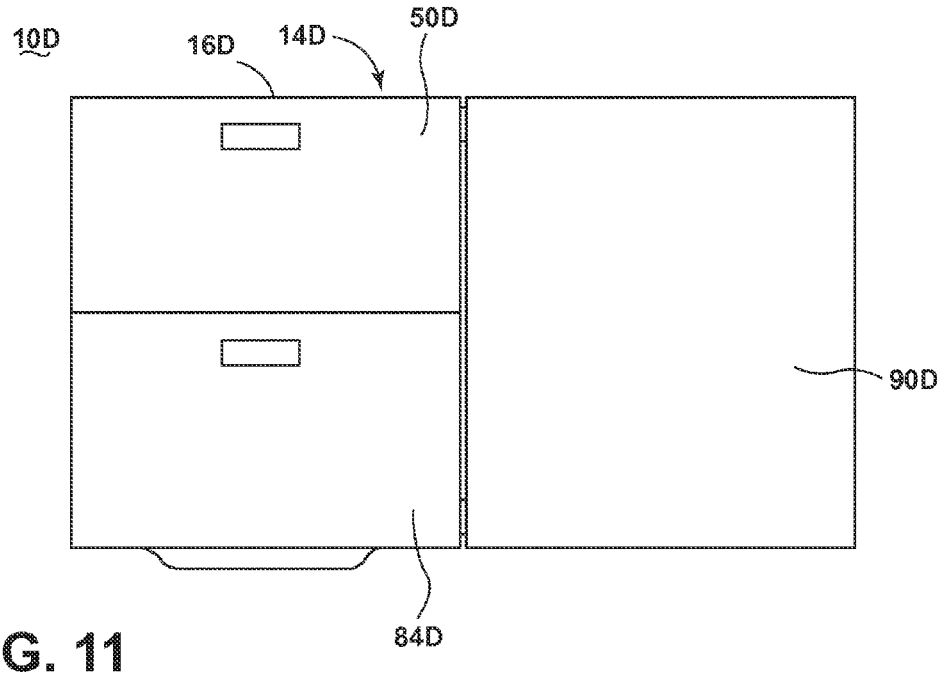
FIG. 11 is a schematic front view of a multi-compartment dishwasher having a closure element system according to another embodiment wherein the exterior closure element is in the form of a door pivotable about a vertical axis.

Various modifications may be made to the closure element system 14. For example, the interior closure elements may both be in the form of pivoting doors, 50A, 84A, as shown schematically in FIG. 8, or slidable drawer fronts, 50B, 84B, as shown schematically in FIG. 9. Further, the exterior closure element may be another type of door, such as French doors pivotable about vertical axes or a single door pivotable about a vertical axis, as respectively shown in opened positions in the schematic illustrations of FIGS. 10 and 11. In the examples of FIGS. 10 and 11 compared to the previous embodiments, the pivot axes for the exterior door 90C, 90D are moved from the bottom edge to the side edge(s) of the exterior door. Further, while the exterior door 90C, 90D opens in a different direction than the interior door 84C, 84D (to the side rather than to the front), the interior door 84C, 84D can still be operatively coupled, such as through a mechanical linkage or cables, with the exterior door 90C, 90D for cooperative movement, if desired.

Also, the dishwasher 10 may include more than two compartments of the same or different sizes having a horizontal or vertical orientation, and each of the compartments may have its own interior closure element, which may be of any suitable type (e.g., sliding drawer front or pivoting door). Regardless of the number and type of interior closure elements, one or more of the interior closure elements may be operatively coupled for cooperative movement with the exterior closure element via latches, if desired, and/or with each other, if desired.

Additionally, when the dishwasher 10 includes a partition in the tub 16 to separate and define the upper and lower treatment chambers 56, 60, the drawer 40 may have a more simplified construction as it needs only to support the dish holder 58 rather than additionally having to form part of the treating chambers 56, 60. For example, the drawer 40 in such an environment may simply have a slidable pan that supports the dish holder 58 and the drawer front panel 50 attached to a front end of the pan.

As mentioned above, the handle 52 on the drawer 40 and the handle 88 on the interior door 84 may have any form and are shown as pocket handles. If the handles 52, 88 protrude forwardly from the front panel 50 and the interior door 84, respectively, such as for a bar handle, the exterior door 90 may be recessed on its inside surface to accommodate the protruding handle(s).

While the invention has been specifically described in connection with certain specific embodiments thereof, it is to be understood that this is by way of illustration and not of limitation, and the scope of the appended claims should be construed as broadly as the prior art will permit.

What is claimed is:

1. A dishwasher automatically executing at least one cycle of operation for treating dishes, the dishwasher comprising:

a tub at least partially defining a first dish treating chamber and a second dish treating chamber and further defining an access opening through which access is provided to the first and second treating chambers;

a first interior closure element movable relative to the tub to selectively close a portion of the access opening corresponding to the first treating chamber and thus preventing access to the first treating chamber;

a second interior closure element movable relative to the tub to selectively close a portion of the access opening corresponding to the second treating chamber and thus preventing access to the second treating chamber;

an exterior closure element mounted to the dishwasher for movement relative to the tub to provide selective access to the first and second interior closure elements, the exterior closure element overlying the first and second interior closure elements when the exterior closure element is closed; and a selectively actuable latch operable between a coupled condition coupling at least one of the first and second interior closure elements to the exterior closure element, wherein the at least one of the first and second interior closure elements simultaneously opens with the exterior closure element, and an uncoupled condition uncoupling the at least one of the first and second interior closure elements from the exterior closure element, wherein the exterior closure element opens independently of the at least one of the first and second interior closure elements.

2. The dishwasher of claim 1 wherein the exterior closure element is pivotally mounted to the dishwasher for pivoting movement relative to the tub.

3. The dishwasher of claim 2 wherein the exterior closure element is pivotally mounted to the dishwasher along a horizontal axis for downward pivoting movement of the exterior closure element.

4. The dishwasher of claim 2 wherein the exterior closure element is pivotally mounted to the dishwasher along a vertical axis for sideways pivoting movement of the exterior closure element.

5. The dishwasher of claim 1 wherein the exterior closure element is a single closure element sized to cover both of the first and second interior closure elements.

6. The dishwasher of claim 1 wherein the exterior closure element comprises a pair of doors pivotally mounted to the dishwasher along respective vertical axes for sideways pivoting movement of the doors.

7. The dishwasher of claim 1 wherein at least one of the first and second interior closure elements is mounted for pivotal movement relative to the tub.

8. The dishwasher of claim 7 wherein both of the first and second interior closure elements are mounted for pivotal movement relative to the tub.

9. The dishwasher of claim 7, further comprising a dish holder slidably coupled to the tub in one of the first and second treating chambers for slidable movement relative to the tub, wherein the one of the first and second interior closure elements corresponding to the treating chamber having the dish holder is coupled to the dish holder for sliding movement with the dish holder relative to the tub, and the other of the first and second interior closure elements is mounted for pivotal movement relative to the tub.

10. The dishwasher of claim 9, further comprising a drawer slidably mounted to the tub and carrying the dish holder to slidably couple the dish holder to the tub, and the one of the first and second interior closure elements corresponding to the treating chamber having the dish holder is coupled to the drawer and forms a front panel for the drawer.

11. The dishwasher of claim 1, further comprising first and second dish holders slidably coupled to the tub in the respective first and second treating chambers for slidable movement relative to the tub, wherein the first and second interior closure elements are coupled to the respective first and second dish holders for sliding movement with the respective dish holders relative to the tub.

12. The dishwasher of claim 11, further comprising first and second drawers mounted to the tub and carrying the respective first and second dish holders to slidably couple the first and second dish holders to the tub, and the first and second interior closure elements are coupled to the respective first and second drawers.

13. The dishwasher of claim 12 wherein the first and second interior closure elements form front panels for the respective first and second drawers.

14. The dishwasher of claim 1 wherein the first interior closure element and the first treating chamber are an upper closure element and an upper treating chamber, and the second interior closure element and the second treating chamber are a lower closure element and a lower treating chamber, and when a cycle of operation is running in the lower treating chamber and not in the upper treating chamber, the upper closure element is operable to provide access to the upper treating chamber.

15. The dishwasher of claim 14, further comprising a lock selectively locking the lower closure element to the tub, wherein when a cycle of operation is running in the lower treating chamber, the lock is operable to secure the lower closure element in a locked position to prevent access to the lower treating chamber.

16. The dishwasher of claim 14 wherein when a cycle of operation is running in the upper treating chamber, the lower closure element is operable to provide access to the lower treating chamber.

17. The dishwasher of claim 1 wherein the first and second interior closure elements are independently operable.

18. The dishwasher of claim 1, further comprising a first liquid sprayer for spraying liquid in the first treating chamber and a second liquid sprayer for spraying liquid in the second treating chamber.

19. The dishwasher of claim 18 wherein the first and second liquid sprayers are independently operable.

20. The dishwasher of claim 1 wherein the latch is in the coupled condition when a cycle of operation is not running in the dish treating chamber corresponding to the at least one of the first and second interior closure elements, and the latch is in the uncoupled condition when a cycle of operation is running in the dish treating chamber corresponding to the at least one of the first and second interior closure elements.

21. The dishwasher of claim 1 wherein the latch comprises an electromagnetic latch on one of the exterior closure element or the at least one of the first and second interior closure elements, and the other of the exterior closure element or the at least one of the first and second interior closure elements is at least partially constructed of a magnetic material that magnetically couples with the electromagnet when the latch is in the coupled condition.

* * * * *